US005322766A

United States Patent [19]

Sowinski et al.

[11] Patent Number: 5,322,766

[45] Date of Patent: Jun. 21, 1994

[54] COLOR PHOTOGRAPHIC RECORDING MATERIAL

[75] Inventors: Allan F. Sowinski; George F. Wu; Thomas B. Brust; James T. Kofron, all of Rochester; Gary L. House, Victor, all of N.Y.

[73] Assignee: Eastman Kodak Company, Rochester, N.Y.

[21] Appl. No.: 4,884

[22] Filed: Jan. 19, 1993

Related U.S. Application Data

[60] Division of Ser. No. 827,857, Jan. 30, 1992, Pat. No. 5,219,715, which is a continuation of Ser. No. 589,159, Sep. 27, 1990, abandoned, which is a continuation-in-part of Ser. No. 419,177, Oct. 10, 1989, abandoned.

[51] Int. Cl.[5] ..... G03C 7/30; G03C 1/035

[52] U.S. Cl. ..... 430/505; 430/506; 430/543; 430/567; 430/359

[58] Field of Search ..... 430/374, 376, 393, 505, 430/506, 543, 544, 567, 568, 359

[56] References Cited

U.S. PATENT DOCUMENTS

| | | | |
|---|---|---|---|
| 3,372,030 | 3/1968 | Jacobson | 96/55 |
| 4,439,520 | 3/1984 | Kofron et al. | 430/434 |
| 4,618,571 | 10/1986 | Ichijima et al. | 430/505 |
| 4,707,434 | 11/1987 | Koboshi et al. | 430/393 |
| 4,720,451 | 1/1988 | Shuto et al. | 430/379 |
| 4,740,454 | 4/1988 | Deguchi et al. | 430/567 |
| 4,748,106 | 5/1988 | Hayashi | 430/503 |
| 4,775,617 | 10/1988 | Goda | 430/567 |
| 4,806,461 | 2/1989 | Ikeda et al. | 430/567 |
| 4,818,667 | 4/1989 | Hamada et al. | 430/502 |
| 4,942,120 | 7/1990 | King et al. | 430/567 |
| 5,023,170 | 6/1991 | Miyoshi et al. | 430/567 |
| 5,051,345 | 9/1991 | Haraga et al. | 430/505 |

FOREIGN PATENT DOCUMENTS

| | | | |
|---|---|---|---|
| 0062202 | 10/1982 | European Pat. Off. . | |
| 0311104 | 4/1989 | European Pat. Off. . | |
| 63-118157 | 5/1988 | Japan | 430/567 |
| 63-226651 | 9/1988 | Japan . | |

OTHER PUBLICATIONS

*Photographic Science*, Mitchell, 1984, pp. 194–195.

*Photographic Materials and Processes*, Stroebel et al., 1986, pp. 533–536.

*Negatives from Ektachrome*, PSA Journal, Dec. 1962, pp. 40–41.

*Primary Examiner*—Lee C. Wright

*Attorney, Agent, or Firm*—Joshua G. Levitt

[57] ABSTRACT

A color negative photographic recording material is described in which low emulsion coverage tabular grain silver halide emulsion imaging units are employed. The silver halide emulsion in at least one of the units comprises grains having a tabularity of between about 50 and 25,000. The imaging unit thickness is less than about 4.0 μm, using a total of no more than 2.0 parts by weight of silver per part of coupler. The imaging unit yields a density of at least 2.0 when exposed and processed.

12 Claims, No Drawings

COLOR PHOTOGRAPHIC RECORDING MATERIAL

This is a divisional of application Ser. No. 827,857, filed Jan. 30, 1992 now U.S. Pat. No. 5,219,715, which is a continuation of Ser. No. 589,159, filed Sep. 27, 1990, abandoned, which is a continuation-in-part of U.S. Ser. No. 419,177, filed Oct. 10, 1989, now abandoned.

The present invention relates to color negative photographic recording materials providing improved performance with reduced silver usage.

In the art related to light sensitive, multilayer color photographic films, the deleterious effect of increased layer thickness on image sharpness is well known. This effect is due to the scattering of light by silver halide grains. Particularly, in multilayer color photographic materials, the decrease in image sharpness of emulsion layers nearer to the support is of special concern.

Previous attempts to improve the sharpness of multilayer color negative photographic materials by reducing the thickness of the image recording layers have had limited success. As the amount of silver halide in an imaging layer is reduced, the smaller number of image-forming centers gives rise to increased granularity. Other important photographic performance parameters, such as speed, exposure latitude, and high contrast in separation (spectral color) exposures, can also be compromised by a reduction in the amount of silver coated in the image-forming layer.

As the sensitivity (speed) of a multilayer color negative photographic material is increased, the production of such materials having thin image-forming layers with low silver coverage, without compromising the other important photographic performance parameters, becomes more difficult. It is often observed that more sensitive multilayer color photographic materials have higher silver coverages but are inferior in color and image quality to less sensitive counterparts. This observation is related to the practice of obtaining increased emulsion sensitivity by enlarging silver halide grain size in order to provide a higher probability of the grain absorbing more light.

This approach to obtaining increased sensitivity is of limited utility due to loss of photoefficiency with relatively large size silver halide grains. This approach also requires that in an attempt to maintain the number of imaging centers, and thereby minimize granularity, the amount of silver used must be increased. The partial grain development encountered in color negative development worsens this situation as a large portion of the coated silver halide remains undeveloped and this proportion becomes greater as the grain volume is increased.

A very useful approach to increasing light capture of a grain is to alter the grain morphology. Employment of high aspect ratio tabular silver halide emulsions, as described in U.S. Pat. Nos. 4,439,520, 4,672,027, and 4,693,954, has succeeded in providing a large variety of advantages to color negative photographic recording materials. Such advantages include improved speed—granularity relationships, increased photographic sensitivity, higher contrast for a given degree of grain size dispersity, higher separations of blue and minus blue speeds, less image variance as a function of processing time and/or temperature variances, the capability of optimizing light transmittance or reflectance as a function of grain thickness, and reduced susceptibility to background radiation or airport x-ray radiation damage in very high speed emulsions.

Silver halide coverages of high speed recording materials that have adequate granularity, regardless of the silver halide grain morphology, degrade the sharpness of underlying layers to an undesirable degree. The unrelenting demands for reduced granularity in high speed films result in the virtually complete use of light incident on the photographic recording material. Accordingly, silver halide emulsion coverages are, in practice, increased to the point where further changes do not produce any appreciable net benefit insofar as granularity is concerned.

Sharpness loss results in part because the recording material structure thickness allows geometrical spread of high angle light to substantial lateral distances. Large grain emulsions are often very turbid at the coating levels necessary to give acceptable granularity and image density, although such difficulty can be minimized by the use of high aspect ratio emulsions. Light scattering by overlying layers creates a high angle light that travels substantial lateral distances in a multilayer photographic material, causing reduction of the material's resolving power.

Further disadvantages accrue from both high silver halide coverage and the resultant substantially diffuse light that is transmitted through the multilayer photographic material. Increasing the diffuseness of incident light encourages its absorption by silver halide particles by increasing the light's path length, or residence time, in the layer. This increased interaction with the silver halide particles provides some higher off-peak absorption, but may not contribute usefully to photographic speed. The absorption of off-peak light, which is undesirable since it results in color contamination, is enhanced to an even greater extent.

Further, absorption of on-peak light by overlying layers intercepts light desired to be absorbed in underlying layers, since the incident light is finite in quantity. Thus, the spectral response of underlying layers can be substantially distorted from their desirable, normal state by these two processes. The broadened spectral response produces less accurate color reproduction, and reduced colorfulness of the rendered image.

Many of these interdependent problems of multilayer photographic materials would be ameliorated if thinner, less turbid silver halide emulsion layers could be utilized. While there are references to reduction in the level of silver or gelatin in a color photographic silver halide recording material, none of these references provide an element in which reducing silver coverage is not at the expense of one or more of speed, density, exposure latitude contrast and/or granularity.

An early attempt to reduce silver coverage involved using the silver image generated on development as a catalyst in an amplification process. Such processes are described in U.S. Pat. Nos. 3,674,490; 3,748,138 and 3,822,129, and referred to in U.S. Pat. No. 4,439,520 cited above. The goal of such materials and processes was to reduce the amount of silver employed in the photographic element. Improvements in photographic performance parameters, such as granularity and color saturation, were not obtained.

Attempts to obtain thin silver halide emulsion layers exhibiting improved sensitivity, and sharpness with reduced graininess, are described in Meyer et al European Patent Application No. 62202 published Oct. 13, 1982. This application positions a photosensitive silver halide emulsion layer between color coupler layers which either do not contain photosensitive silver halide or which contain only silver halide of low sensitivity. However, overall reduction in silver usage is not realized.

Japanese Kokai No. 63-226651 seeks color negative photographic materials having improved sharpness and lowered sensitivity to background radiation through reduced silver usage. However, density is sacrificed at lower silver coverages.

U.S. Pat. No. 4,818,667 describes use of photographic recording materials having a total thickness not greater than 18 μm while preserving image sharpness. However, this patent does not teach reduction in silver usage while still maintaining desired density values.

European Patent Application 311104 published Apr. 12, 1989, describes photographic recording material having from 3.0 to 9.0 g/m$^2$ of However, there is no indication that satisfactory density values, adequate contrast or reduced granularity values can be obtained with these materials.

There remains a need for color negative photographic recording materials having thin layers and low silver coverage and having improved photographic performance without sacrificing speed.

SUMMARY OF THE INVENTION

The present inventors have surprisingly found that when certain silver halide emulsions are used, the coverage of silver halide in an imaging unit can be substantially reduced below that commonly employed in color negative silver halide photographic elements without sacrificing image density, contrast and graininess and without the need for a special amplification process. This permits the preparation of higher speed (ISO speed$\geqq$100) color negative photographic materials that provide performance equal to or better than currently available color negative materials at the same speed while at the same time reducing the amount of silver in the element.

Thus, in one embodiment, this invention provides a color negative photographic recording material containing a support and at least two silver halide emulsion imaging units sensitive to different regions of the electromagnetic spectrum, each unit containing a dye-forming coupler, at least one unit:

(a) comprises from 0.2 to 2.0 g/m$^2$, silver, of a silver halide emulsion wherein greater than 50% of the projected area of the grains is provided by tabular grains having a tabularity of between 50 and 25,000;

(b) has a thickness of less than about 4.0 μm;

(c) comprises no more than 2.0 parts by weight of silver per part of coupler; and (d) yields a maximum image dye density of at least 2.0, when the recording material is exposed and processed.

The color negative photographic recording materials to which this invention relates typically have an exposure latitude of 2.0 or greater and a contrast (gamma) of 0.9 or less, but that is positive in sign. Exposure latitude and contrast are defined and measured as described in Strobel et al., *Photographic Materials and Processes*, pp. 46-50Focal Press, Boston, 1986.

Some color photographic materials intended for reversal processing may have been described as containing silver levels and silver to coupler ratios within the ranges described above. However, such reversal materials are not useful as color negative materials since they would not have the exposure latitude and contrast required.

The results observed with the present invention contradict the expectation that lowering the silver halide emulsion coverage and forming a thin layer would result in reduced image density in the high speed materials of the type to which this invention is directed. The use of less silver and thinner layers leads to a number of advantages. The sharpness of photographic images is substantially improved, the transmission of light to underlying layers is improved, the minus blue to blue speed separation is enhanced, and sensitivity to higher energy background radiation or X-ray radiation is reduced.

The use of less silver results in the use of less gelatin, and can result in the use of less coupler, related solvents and/or dispersing agents. This further contributes to the thinning of the layer and provides lowered raw material costs. Thinner photographic layers containing reduced silver levels can lead to an increase in the transmission of incident light as well as an improvement in the partition of absorbed light among the spectrally sensitized layers. Moreover, thinner photographic layers containing reduced silver levels can lead to reduced consumption of processing chemicals, notably fixing agents, thereby reducing the cost of disposing of these chemicals.

The tabular grain silver halide emulsions that are useful in the present invention can be comprised of silver bromide, silver chloride, silver iodide, silver chlorobromide, silver chloroiodide, silver bromoiodide, silver chlorobromoiodide or mixtures thereof. These emulsions include (i) high aspect ratio tabular grain emulsions and (ii) thin intermediate aspect ratio tabular grain silver halide emulsions. High aspect ratio tabular grain emulsions are those which exhibit an average aspect ratio of greater than 8:1. Thin, intermediate aspect ratio emulsions are those in which the tabular grains have an average thickness of less than 0.2 μm and an average aspect ratio ranging from 5:1 to 8:1. Such emulsions are disclosed by Wilgus et al U.S. Pat. No. 4,434,226, Daubendiek et al U.S. Pat. No. Wey U.S. Pat. No. 4,399,215, Solberg et al U.S. Pat. No. 4,433,048, Mignot U.S. Pat. No. 4,386,156, Evans U.S. Pat. No. 4,504,570, Maskasky U.S. Pat. No. 4,400,463, Wey et al U.S. Pat. No. 4,414,306, U.S. Pat. Nos. 4,435,501 and 4,643,966 and et al U.S. Pat. Nos. 4,672,027 and 4,693,964. Also specifically contemplated are those silver bromoiodide grains with a higher molar proportion of iodide in the core than in the periphery of the grain, such as those described in GB 1,027,146; JA 54/48,521; U.S. Pat. No. 4,379,837; U.S. Pat. No. U.S. Pat. No. 4,665,614; U.S. Pat. No. 4,636,461; and U.K. patent application numbers 8916041.0 and 8916042.8both filed Jul. 13, 1989, and entitled PROCESS OF PREPARING A TABULAR GRAIN SILVER BROMOIODIDE EMULSION AND EMULSIONS PRODUCED THEREBY. The silver halide emulsions can be either monodisperse or polydisperse as precipitated. The grain size distribution of the emulsions can be controlled by techniques of separation and blending of silver halide grains of different types and sizes, including tabular grains, as previously described in the art, for example, in U.S. Pat. No. 4,865,964, issued Sep. 12, 1989, entitled BLENDED EMULSIONS EXHIBITING IMPROVED SPEED-GRANULARITY RELATIONSHIPS.

The high aspect ratio tabular grain emulsions and the thin intermediate aspect ratio tabular grain emulsions, as well as other emulsions useful in this invention, can be characterized by a relationship called "tabularity", ($\bar{T}$), which is related to aspect ratio (AR). This relationship can be defined by the following equations:

$$AR = \frac{ecd}{t} \quad (1)$$

$$T = \frac{AR}{t} = \frac{ecd}{t^2} \quad (2)$$

where ecd is the average equivalent circular diameter of the tabular grains, and t is the average thickness of the tabular grains, where dimensions are measured in micrometers.

Tabular grains are those having two substantially parallel crystal faces, each of which is substantially larger than any other single crystal face of the grain. The term "substantially parallel" as used herein is intended to include surfaces that appear parallel on direct or indirect visual inspection at 10,000× magnification.

The grain characteristics described above of the silver halide emulsions of this invention can be readily ascertained by procedures well known to those skilled in the art. The equivalent circular diameter of the grain is defined as the diameter of a circle having an area equal to the projected area of the grain as viewed in a photomicrograph, or an electron micrograph, of an emulsion sample. From shadowed electron micrographs of emulsion samples it is possible to determine the thickness and the diameter of each grain as well as the tabular nature of the grain. From these measurements the average thickness, the average ecd, and the tabularity can be calculated.

The projected areas of the tabular silver halide grains meeting the tabularity criteria can be summed. The projected areas of the remaining silver halide grains in the photomicrograph can be separately summed. From the two sums the percentage of the total projected area of the silver halide grains provided by the tabular grains meeting the tabularity criteria can be calculated.

Good results are obtained when the tabular grain emulsion has a tabularity of from 50 to 25,000;

preferred are elements in which at least one of the emulsions has a tabularity of from 100 to 5,000; and especially preferred are elements that employ an emulsion with a tabularity of from 100 to 2,500.

As used herein, the term "unit" refers to all of the layers in the element intended to record radiation in a given region of the spectrum and form a corresponding dye image. It will be appreciated that each imaging unit can be comprised of one or more silver halide emulsion layers sensitive to the same region of the spectrum. It is common with high speed color negative materials of the type to which this invention relates, for each unit to be composed of 2 or 3 layers, which can be adjacent or not. At least one of the layers in the unit is, as indicated above, comprised of a silver halide emulsion in which greater than 50% of the projected area is provided by silver halide grains having a tabularity of 50 to 25,000. Preferably, if the unit is comprised of more than one layer, this emulsion is in the most sensitive of the layers, although other of the layers, or all of the layers, can be comprised of an emulsion with a tabularity of 50 to 25,000. The emulsion(s) employed in the other layer(s) can be a non-tabular emulsion or a tabular emulsion that does not satisfy the tabularity criteria enumerated above so long as the projected area criterion for the unit is satisfied. If desired, other silver halide emulsions can be blended with the high tabularity emulsion, so long as the projected area criterion is satisfied.

The silver halide in these other emulsions can, as with the tabular emulsion, be comprised of silver bromide, silver chloride, silver iodide, and mixtures of halides such as silver bromoiodide, silver chlorobromide and silver chlorobromoiodide. Especially preferred silver halides, for all of the emulsions in the element, are silver bromoiodides. Preferred proportions of iodide are from 3 to 12 mole percent although lesser or greater (up to the limit of iodide solubility in bromide) proportions of iodide can be used. When mixed halides are used in the emulsion grain, the proportions of the halide can be uniform throughout the grain, or the proportions can vary continuously or discontinuously across the diameter of the grain, as in core-shell or multiple structure grains.

The amount of silver halide in the imaging unit of this invention is from 0.2 to 2.0 g/m$^2$, based on silver. When the color photographic recording unit has two or more silver halide layers of different sensitivities to the same region of the visible spectrum it is preferred that the more sensitive layer comprise from about 0.10 to about 1.0 g/m$^2$ of silver, and the less sensitive layer or layers comprise sufficient silver to meet the total unit imaging requirement as noted above. Preferably, the more sensitive layer can comprise from about 0.20 to about 0.6 g/m$^2$ of silver.

One of the features of the photographic recording materials of this invention is the reduction made possible in silver-to-coupler ratio. For example, conventional color negative photographic recording materials utilize a substantial excess of silver as compared to coupler so that a ratio of about 3 parts of silver per part of coupler is commonplace. Utilization of the instant invention permits use of at least one-third less silver using the same amount of image coupler. Thus, the silver to coupler ratio is 2.0 to 1 or less by weight and can go as low as 0.5 to 1 or lower. Preferably, the element employs a silver to coupler ratio in the range of 0.8:1 to 1.5:1. In determining silver to coupler ratio all of the compounds that couple with oxidized developing agents that are in the unit are counted whether or not they contribute to image density.

Gelatin is commonly used as a vehicle to suspend silver halide grains and prevent their formation of clumps. Reduction in the amount of silver and the use of lower silver to coupler ratios than heretofore leads to use of less binder or vehicle.

With this invention it is possible to reduce gelatin usage by greater than 50%, of that commonly used while retaining desirable image features and obtaining manufacturing and ecological advantages. For example, typical cyan and magenta imaging units in color negative photographic materials contain 2 to 3.3 g/m$^2$ of gelatin. With the instant invention it is also possible to reduce the level of gelatin usage to about 0.5 to 1.5 g/m$^2$.

The improvements made possible by the use of the above described tabular silver halide grains coupled with reductions in the amounts of silver halide and of gelatin lead to an appreciably thinner light sensitive recording unit. Thus, color-forming units of this invention have thicknesses of less than 4.0 μm, with units as thin as 2.0 μm, or less being possible. Preferred color-forming units have thicknesses in the range of 2.5 to 3.5 μm. In measuring unit thickness only the dye-forming silver halide layers are included.

As is typical of color negative materials, the photographic elements of this invention preferably contain a development inhibitor releasing coupler, especially in the higher speed layer of a given unit. Typical DIR couplers are described in U.S. Pat. Nos. 3,148,062; 3,227,554; 3,617,291; 4,095,984; 4,248,962; 4,409,323; 4,477,563; and 4,782,012.

Inasmuch as improvements in photographic performance become more difficult to achieve as the speed of the material is increased, the advantages of this invention are particularly applicable to the higher speed materials, i.e. 100 ISO and greater. The advantages become especially significant for materials having speeds of 400 to about 6400 ISO.

The photographic recording materials of this invention are multicolor color elements that contain dye imaging units sensitive to different regions of the electromagnetic spectrum. Each unit can be comprised of a single silver halide emulsion layer or of multiple emulsion layers sensitive to a given region of the spectrum. The layers of the element, including the layers of the image-forming units, can be arranged in various orders as is known in the art, for example, from U.S. Pat. Nos. 4,400,463 and 4,599,302.

Typically the element comprises imaging units that yield a cyan, magenta and yellow dye image and the silver halide associated with each unit is sensitized to the complementary region of the electromagnetic spectrum. However, one or more of the silver halide layers can be false sensitized to a region of the spectrum that is not the complement of the dye produced by the coupler with which it is associated. For example, one, two, or three of the imaging units can be sensitized to different portions of the infrared region of the spectrum.

At least one of the imaging units of the element is an imaging unit having the characteristics defined above. It is preferred that this unit be a magenta dye-forming unit or a cyan dye forming unit since the visual information provided by each of these units is of greater significance than that provided by the yellow dye forming unit. In a preferred embodiment, both of these imaging units have the characteristics described above.

A typical multicolor photographic recording material comprises a support bearing a cyan dye image-forming unit comprising at least one red-sensitive silver halide emulsion layer having associated therewith at least one cyan dye-forming coupler, a magenta image forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. In addition to the coupler that forms a dye complementary to the sensitization of the associated silver halide emulsion, the layer can contain one or more non-complementary couplers in order to modify perceived photographic performance. The recording material is coated on a support and can contain additional layers, such as filter layers, image modifier layers, interlayers, overcoat layers, subbing layers, and the like.

The maximum image density of at least 2.0 is obtained by processing the element in the way it is intended to be used. Image density refers to the density range between Dmin and Dmax of the exposed and processed element. This would be one of the common color negative processes used to develop color negative amateur and motion picture films such as the ECN-2 or C-41 process. A typical process is described in the 1988 Annual of the British Journal of Photography pages 196–198, and is as follows:

(1). develop for 3 minutes, 15 seconds at 37.8° C. in a solution comprising:

| | |
|---|---|
| Potassium carbonate, anhydrous | 34.30 g |
| Potassium bicarbonate | 2.32 g |
| Sodium sulfite, anhydrous | 0.38 g |
| Sodium metabisulfite | 2.78 g |
| Potassium iodide | 1.20 mg |
| Sodium bromide | 1.31 g |
| Diethylenetriaminepentaacetic acid pentasodium salt (40% solution) | 8.43 g |
| Hydroxylamine sulfate | 2.41 g |
| Kodak Color Developing Agent CD-4 {2-[(4-amino-3-methylphenyl) ethylamino]ethanol sulfate} | 4.52 g |
| Water to make | 1 liter |
| pH @ 26° C. 10.0 +/− 0.05 | |

(2). bleach for 4 minutes at a temperature of 37.8° C. in a solution comprising:

| | |
|---|---|
| Ammonium bromide | 50.00 g |
| 1,3 Propanediaminetetraacetic acid | 30.27 g |
| Ammonium hydroxide (28%) ammonia | 35.20 g |
| Ferric nitrate nonahydrate | 36.40 g |
| Glacial acetic acid | 26.50 g |
| 1,3 diamino-2-propanoltetraacetic acid | 1.00 g |
| Ammonium ferric EDTA (1.56M, pH 7.05, 44% wt.) (contains 10% molar excess EDTA, 3.5% wt.) | 149.00 g |
| Water to make | 1 liter |

(3). wash with water for 3 minutes at 35°–36° C.;

(4). fix for 4 minutes at a temperature of 37.8° C. in a solution comprising:

| | |
|---|---|
| Ammonium thiosulfate (58% solution) (less than 1% ammonium sulfite) | 214.00 g |
| (Ethylenedinitrilo)tetraacetic acid disodium salt, dihydrate | 1.29 g |
| Sodium metabisulfite | 11.00 g |
| Sodium hydroxide (50% solution) | 4.70 g |
| Water to make | 1 liter |
| pH of 6.5 ± 0.15; | |

(5). wash with water for 3 minutes at 35°–36° C.; and (6). stabilize for 1 minute at 37.8° C. in a solution comprising:

| | |
|---|---|
| Formaldehyde (37% solution, 12% methanol) | 3.60 g |
| Polyalkoxylate dimethylpolysiloxane | 0.83 g |
| Water to make | 1 liter |

In the following discussion of suitable materials for use in the recording materials of this invention, reference will be made to *Research Disclosure*, December 1978, Item 17643, published by Kenneth Mason Publications, Ltd., Dudley Annex, 12a North Street Emsworth Hampshire PO10 7DQ, ENGLAND, the disclosures of which are incorporated herein by reference. This publication will be identified hereafter by the term "*Research Disclosure*".

Sensitizing compounds, such as compounds of copper, thallium, lead, bismuth, cadmium, selenium, iridium and other Group VIII noble metals, can be present during precipitation of the silver halide emulsions.

The silver halide emulsions can be chemically sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 17643, cited above, Section III. The chemical sensitization can be accomplished in the presence of finish modifiers such as those described in U.S. Pat. No. 4,578,348.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure*, Item 17643, cited above, Section IV.

Suitable vehicles for the emulsion layers and other layers of elements of this invention are described in Research Disclosure Item 17643, Section IX and the publications cited therein.

Couplers useful in this invention can be polymeric or nonpolymeric. Typical cyan dye forming couplers that are useful in this invention are phenols and naphthols. Typical magenta dye forming couplers are pyrazolones and pyrazoloazoles. Typical yellow dye forming couplers are acetoacetanilides and benzoylacetanilides. Such dye image-forming couplers, which can be of the one, two or four equivalent type and can be coated in or adjacent to silver halide emulsion layers to be free to react with oxidized developing agent to form the desired image. Minor amounts of masking couplers and couplers which form different colored images may be incorporated within the dye forming units of the present invention. For example, the addition of a small amount of a cyan coupler to a magenta dye forming layer will alter the hue of the resulting magenta image. In addition, the imaging unit can contain image modifying couplers and compounds which release development inhibitor moieties, development accelerator moieties or bleach accelerating moieties. These moieties are released from such compounds, or from a timing group contained within such compounds, as the result of processing.

The photographic recording materials of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research disclosure Section VIII), hardeners (Research Disclosure Section XI), plasticizers and lubricants (Research Disclosure Section XII), matting agents (Research Disclosure Section XVI) and development modifiers (Research Disclosure Section XXI). The photographic materials can have incorporated therein developing agents to render them suitable for activation processing as described in U.S. Pat. No. 3,342,599.

The photographic recording materials can be coated on a variety of supports as described in Research Disclosure Section XVII and the references described therein.

Photographic recording materials can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

The following examples further illustrate this invention.

A series of color negative, incorporated coupler photographic materials were prepared by coating the following layers in order, on a cellulose triacetate film support. The physical properties of the emulsions utilized, the unit silver coverages, silver to coupler ratio, and unit thickness of the magenta units are described in Tables I and II which follow the description of the preparation of the photographic materials.

A first photographic recording material of the invention was prepared by coating the following layers, in order, on a cellulose triacetate film support bearing a layer of black colloidal silver sol at 0.30 g/m$^2$ and gelatin at 2.44 g/m$^2$. The material was designated Element I.

Element I (Invention)

Layer 1 Slow Cyan Layer—comprising red-sensitized tabular silver bromoiodide grains (3.9 mole % I$^-$) at 0.70 gAg/m$^2$, gelatin at 1.61 g/m$^2$, cyan image-forming coupler A at 0.54 g/m$^2$, DIR coupler B at 0.0043 g/m$^2$, masking coupler C at 0.068 g/m$^2$, and antifoggant 4-hydroxy-6-methyl-1,3,3a, 7-tetraazaindene at 0.012 g/m$^2$.

Layer 2 Fast Cyan Layer—comprising faster red-sensitized tabular silver bromoiodide grains (4.0 mole % I$^-$) at 0.65 gAg/m$^2$, gelatin at 1.15 g/m$^2$, cyan image-forming coupler D at 0.29 g/m$^2$, masking coupler C at 0.029 g/m$^2$, and antifoggant 4-hydroxy-6-methyl-1,3,3a, 7-tetraazaindene at 0.011 g/m$^2$.

Layer 3 Interlayer—comprising gelatin at 0.65 g/m$^2$ and oxidized developer scavenger didodecylhydroquinone at 0.054 g/m$^2$.

Layer 4 Slow Magenta Layer—comprising green-sensitized tabular silver bromoiodide grains (2.4 mole % I$^-$) at 0.52 gAg/m$^2$, gelatin at 1.16 g/m$^2$, image-forming couplers E at 0.30 g/m$^2$ and F at 0.13 g/m$^2$, DIR coupler B at 0.027 g/m$^2$, masking coupler G at 0.069 g/m$^2$, and antifoggant 4-hydroxy-6-methyl-1,3,3a, 7-tetraazaindene at 0.008 g/m$^2$.

Layer 5 Fast Magenta Layer—comprising faster green-sensitized tabular silver bromoiodide grains (4.0 mole % I$^-$) at 0.39 gAg/m$^2$, gelatin at 0.60 g/m$^2$, image-forming couplers E at 0.075 g/m$^2$ and F at 0.032 g/m$^2$, DIR coupler H at 0.006 g/m$^2$, masking coupler G at 0.017 g/m$^2$, and antifoggant 4-hydroxy-6-methyl-1,3,3a, 7-tetraazaindene at 0.006 g/m$^2$.

Layer 6 Yellow Filter Layer—comprising gelatin at 0.65 g/m$^2$, Carey Lea silver at 0.022 g/m$^2$, and oxidized developer scavenger didodecylhydroquinone at 0.054 g/m$^2$.

Layer 7 Slow Yellow Layer—comprising blue-sensitized tabular silver bromoiodide grains (4.2 mole % I$^-$) at 0.32 gAg/m$^2$, gelatin at 1.61 g/m$^2$, image-forming coupler I at 1.08 g/m$^2$, DIR coupler J at 0.065 g/m$^2$, and antifoggant 4-hydroxy-6-methyl-1,3,3a, 7-tetraazaindene at 0.008 g/m$^2$.

Layer 8 Fast Yellow Layer—comprising faster blue-sensitized tabular silver bromoiodide grains (3.0 mole % I−) at 0.59 gAg/m², gelatin at 1.20 g/m², image-forming coupler I at 0.43 g/m², DIR coupler J at 0.032 g/m², and antifoggant 4-hydroxy-6-methyl-1,3,3a, 7-tetraazaindene at 0.009 g/m².

Layer 9 Protective Overcoat and UV Filter Layer—comprising gelatin at 1.22 g/m², silver bromide Lippmann emulsion at 0.11 g/m², UV absorbers at 0.23 g/m², and bis(vinylsulfonyl)methane added at 2.0% of total gelatin weight.

Element II (Invention)

A second photographic recording material of the invention, designated Element II, was prepared in a similar manner to Element I. The following modifications were made in the magenta dye forming unit.

Layer 4 Slow Magenta Layer—DIR Coupler B was reduced to 0.019 g/m².

Layer 5 Fast Magenta Layer—the coverage of the faster green-sensitized tabular silver bromoiodide grains was increased to 0.65 gAg/m², gelatin increased to 0.97 g/m² and DIR coupler H was 0.011 g/m².

A third color photographic recording material of the invention, designated Element III, for color negative development was prepared by applying the following layers in the given sequence to a transparent support of cellulose triacetate. All silver halide emulsions were stabilized with 2 grams of 4-hydroxy-6-methyl-1,3,3a, 7-tetraazaindene per mole of silver.

Element III (Invention)

Layer 1 (Antihalation Layer) Black colloidal silver sol containing 0.236 g/m² of silver and 2.44 g/m² gelatin.

Layer 2 Slow Cyan layer—Comprising red-sensitized silver iodobromide emulsion (4 mol % I−) at 0.194 g/m², red-sensitized silver iodobromide emulsion (4 mol % I−) at 0.280 g/m², cyan dye-forming image coupler D at 0.463 g/m², DIR compound B at 0.032 g/m², BAR compound N at 0.020 g/m², with gelatin at 1.053 g/m².

Layer 3 Fast Cyan Layer—Comprising red-sensitized silver iodobromide emulsion (4.1 mol % I−) at 0.495 g/m², cyan dye-forming image coupler D at 0.183 g/m², DIR compound B at 0.019 g/m², BAR compound N at 0.016 g/m², with gelatin at 0.720 g/m².

Layer 4 (Interlayer) comprising oxidized developer scavenger didodecylhydroquinone at 0.054 g/m², dye MD-1 at 0.107 g/m², and dye YD-1 0.150 g/m² with 0.645 g/m² of gelatin.

Layer 5 Slow Magenta Layer—Comprising green-sensitized silver iodobromide emulsion (2.6 mol % I−) at 0.204 g/m², green-sensitized silver iodobromide emulsion (3 mol % I−at 0.065 g/m², magenta dye-forming image coupler E at 0.151 g/m², magenta dye-forming image coupler F at 0.194 g/m², DIR compound B at 0.012 g/m² with gelatin at 0.613 g/m².

Layer 6 Fast Magenta Layer—Comprising green-sensitized silver iodobromide emulsion (4 mol % I−) at 0.430 g/m², magenta dye-forming image coupler E at 0.0425, magenta dye-forming image coupler F at 0.043 g/m², DIR compound H at 0.0097 g/m² with gelatin at 0.527 g/m².

Layer 7 (Interlayer) Comprising oxidized developer scavenger didodecylhydroquinone at 0.54 g/m², yellow colloidal silver at 0.022 g/m² with 0.645 g/m² of gelatin.

Layer 8 Slow Layer—Comprising blue-sensitized silver iodobromide emulsion (4 mol % I−) at 0.322 g/m², yellow dye-forming image coupler I at 0.613 g/m², DIR compound J at 0.0194 g/m², 2-propargylamino-benzoxazole at 0.043 mg/m² with gelatin at 0.914 g/m².

Layer 9 Fast Yellow Layer—Comprising blue-sensitized silver iodobromide emulsion (3 mole % I−) at 0.409 g/m², yellow dye-forming image coupler I at 0.226 g/m², DIR compound J at 0.0097 g/m², 2-propargylamino-benzoxazole at 0.043 mg/m² with gelatin at 0.645 g/m².

Layer 10 (Protective Layer 1) 0.967 g/m² of gelatin, 0.108 g/m² of dye UV-1, 0.118 g/m² of dye UV-2.

Layer 11 (Protective Layer 2) Unsensitized silver bromide Lippman emulsion at 0.108 g/m², anti-matte polymethylmethacrylate beads at 0.025 g/m², gelatin at 0.54 g/m² with 2% by weight to total gelatin of hardener H-1.

A comparative control color negative photographic recording material designated Element IV, that is known to produce ISO 400 speed, was coated in an analogous fashion on a cellulose triacetate support bearing an antihalation layer in the layer order recited:

Layer 1 Slow Cyan Layer—comprising a blend of three red-sensitized silver bromoiodide grains, a medium size tabular grain emulsion (6.0 mole % I−) at 0.91 gAg/m², a smaller tabular grain emulsion (3.0 mole % I−) at 0.28 gAg/m² and a non-tabular grain emulsion (4.8 mole % I−) at 0.97 gAg/m², gelatin at 2.59 g/m², cyan image-forming coupler A at 0.72 g/m², DIR coupler K at 0.044 g/m², masking coupler C at 0.054 g/m², bleach accelerator releasing coupler N at 0.075 g/m², and antifoggant 4-hydroxy-6-methyl-1,3,3a, 7-tetraazaindene at 0.071 g/m².

Layer 2 Fast Cyan Layer—comprising faster red-sensitized tabular silver bromoiodide grains (6.0 mole % I−) at 1.29 gAg/m², gelatin at 1.73 g/m², cyan image-forming coupler D at 0.23 g/m², DIR coupler K at 0.043 g/m², masking coupler C at 0.043 g/m² and antifoggant 4-hydroxy-6-methyl-1,3,3a, 7-tetraazaindene at 0.043 g/m².

Layer 3 Interlayer—comprising gelatin at 1.29 g/m² and dye YD-1 at 0.031 g/m².

Layer 4 Slow Magenta Layer—comprising a blend of green-sensitized silver bromoiodide grains, tabular silver bromoiodide grains (3.0 mole % I−) at 0.38 gAg/m², non-tabular silver bromoiodide grains (4.8 mole % I−) at 0.81 g/m², gelatin at 2.15 g/m², image-forming coupler F at 0.59 g/m², DIR coupler H at 0.011 g/m², masking coupler G at 0.059 g/m², and antifoggant 4-hydroxy-6-methyl-1,3,3a,7-tetraazaindene at 0.019 g/m².

Layer 5 Fast Magenta Layer—comprising faster green-sensitized tabular silver bromoiodide grains (6.0 mole % I−) at 1.23 gAg/m², gelatin at 1.80 g/m², image-forming coupler F at 0.17 g/m², DIR coupler H at 0.011 g/m², masking coupler G at 0.028 g/m², and antifoggant 4-hydroxy-5-methyl-1,3,3a,7-tetraazaindene at 0.015 g/m².

Layer 6 Yellow Filter Layer—comprising gelatin at 1.29 g/m², and Cary Lea silver at 0.022 g/m².

Layer 7 Slow Yellow Layer—comprising blue-sensitized tabular silver bromoiodide grains (6.0 mole % I−) grains at 0.75 gAg/m², gelatin at 2.27 g/m², image-forming coupler L at 1.58 g/m², DIR coupler M at 0.083 g/m², antifoggant 4-hydroxy-6-methyl-1,3,3a,7-tetraazaindene at 0.012 g/m².

Layer 8 Fast Yellow Layer—comprising faster blue-sensitized low aspect ratio silver bromoiodide grains (9.0 mole % I−) at 0.74 g/m², gelatin at 1.60 g/m², image-forming coupler L at 0.23 g/m², and antifoggant 4-hydroxy-6-methyl-1,3,3a,7-tetraazaindene at 0.012 g/m².

Layer 9 Protective Overcoat and UV Filter Layer—comprising gelatin at 1.15 g/m², silver bromide Lippmann emulsion at 0.22 gAg/m² and bis(vinylsulfonyl)methane added at 2.0% of total gelatin weight

TABLE I

PROPERTIES OF EMULSIONS

| Magenta Unit | Silver Coverage gAg/m² | Mean ecd (μm) | Mean t (μm) | AR | $\bar{T}$ |
|---|---|---|---|---|---|
| Element I (Inv) | | | | | |
| Fast Layer | 0.39 | 1.94 | 0.085 | 23 | 270 |
| Slow Layer | 0.51 | 0.75 | 0.089 | 8.4 | 95 |
| Element II (Inv) | | | | | |
| Fast Layer | 0.65 | 1.94 | 0.085 | 23 | 270 |
| Slow Layer | 0.52 | 0.75 | 0.089 | 8.4 | 95 |
| Element III (Inv) | | | | | |
| Fast Layer | 0.43 | 1.97 | 0.079 | 25 | 316 |
| Slow Layer (Blend) | 0.065 | 1.21 | 0.081 | 15 | 184 |
| | 0.20 | 0.64 | 0.089 | 7.2 | 81 |
| Element IV (Control) | | | | | |
| Fast Layer | 1.18 | 2.9 | 0.14 | 21 | 150 |
| Slow Layer (Blend) | 0.25 | 1.2 | 0.13 | 9.2 | 71 |
| | 0.08 | 0.68 | 0.11 | 6.2 | 56 |
| | 0.86 | 0.32 | — | <3 | — |
| Yellow Unit of Element III (Inv) | | | | | |
| Fast | 0.41 | 2.6 | 0.12 | 22 | 183 |
| Slow | 0.32 | 0.90 | 0.10 | 9 | 90 |

TABLE II

PHYSICAL DESCRIPTION AND INGREDIENT COVERAGES OF THE MAGENTA UNITS OF THE MULTICOLOR PHOTOGRAPHIC MATERIALS

| | Unit Silver (g/m²) | Unit Silver/ Coupler Ratio | Unit Thickness (μm) |
|---|---|---|---|
| Magenta Unit of | | | |
| Element I (Inv) | 0.90 | 1.39 | 3.2 |
| Element II (Inv) | 1.17 | 1.79 | 3.5 |
| Element III (Inv) | 0.70 | 1.44 | 2.2 |
| Element IV (Control) | 2.36 | 2.78 | 6.0 |
| Yellow Unit of Element III (Inv) | 0.73 | 0.85 | 3.2 |

The above described photographic elements were evaluated to determine photographic performance as reported in Table III. In one evaluation, each element was exposed for 1/100 of a second to a 600 W, 3000° K. tungsten light source that was filtered by a Daylight Va filter to 5500° K. through a graduated 0–4.0 density step tablet to determine minimum density and gamma. In another evaluation each element was exposed as the first, except that the exposure time was 0.2 second, to allow determination of the maximum density. In another evaluation, each element was exposed at 0.2 second and a green Wratten 99 filter was added in order to assess the separation exposure gamma and maximum density. To determine the rms granularity, by the method described in H. C. Schmitt, Jr. and J. H. Altman, Applied Optics 9, pp. 871–874, April 1970, each element was exposed as in the first evaluation, except the filter pack contained a 0.6 neutral density and the 0–4.0 density step tablet was replaced by a 0–3.0 density step tablet and matte glass diffuser.

The sharpness measurements were made by determining the Modulation Transfer Function (MTF) by the procedure described in *Journal of Applied Photographic Engineering*, 6 (1): 1–8, 1980. Modulation Transfer Functions for red light were obtained by exposing each element for 1/15 second at 60% modulation using 70 B and 20 C KODAK Color Compensating Filters, and a 0.2 neutral density filter.

The exposed samples were developed for 3.25 minutes in the 6-step development process described above on pages 16 and 17. The processed film strips were then evaluated for speed, contrast, net maximum density (Dmax minus Dmin) for both white light and green light exposures and granularity for the magenta color-forming unit. The 35 mm System Cascaded Modulation Transfer (AMT) Acutance Ratings are reported in Table III for the cyan color-forming unit. The results are shown in Table III.

TABLE III

MULTICOLOR PHOTOGRAPHIC PERFORMANCE

| | Speed (Log E) @ D = 0.15 | Contrast γ | MAGENTA UNIT Net Max. Density 5500° K. Exp. | 5500° K. + WR99 Exp. | Granularity σD at D = 1.4 | CYAN UNIT 35 mm System AMT Acutance | Thickness[1] |
|---|---|---|---|---|---|---|---|
| Element I (Inv.) | 2.86 | 0.65 | 2.09 | 2.50 | 0.014 | 93.9 | 13.5 |
| Element II (Inv.) | 2.89 | 0.65 | 2.37 | 2.75 | 0.012 | 91.4 | 14.3 |
| Element III (Inv) | 2.78 | 0.83 | 2.32 | 2.32 | 0.020 | 92.5 | 9.5 |
| Element IV (control) | 2.76 | 0.64 | 2.12 | 2.21 | 0.011 | 89.8 | 21.6 |
| Yellow Unit of Element III | 2.72 | 0.60 | 2.14 | — | .026 | 92.5 | 9.5 |

[1]Thickness in microns of all imaging units in film, measured from top of antihalation layer to top of fast yellow layer at 22° C. and 50% relative humidity.

The construction of a thin color magenta color forming unit containing tabular grain silver halide emulsions of the preferred grain tabularity according to the present invention is shown to provide improved sharpness in underlying emulsion layers while improving or maintaining sensitivity, contrast, maximum density and granularity at substantially exposure latitude, reduced silver coverage.

Structures

Coupler A

-continued
Structures
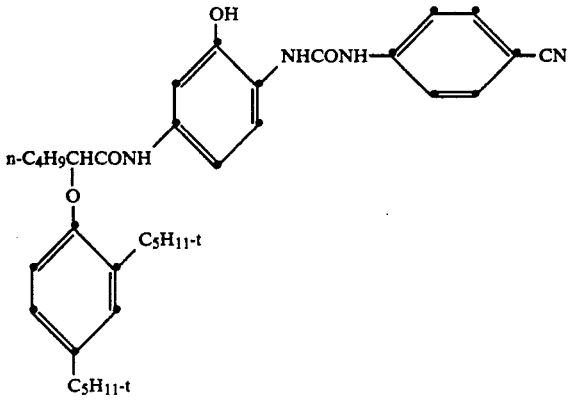
Coupler B
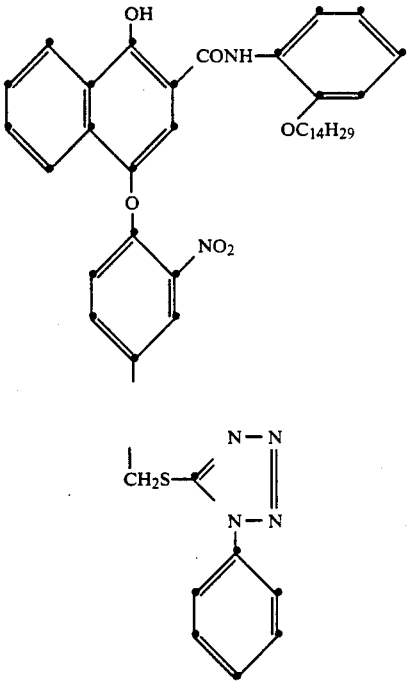
Coupler C
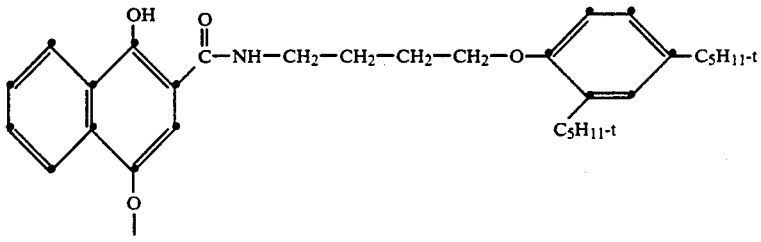

-continued
Structures
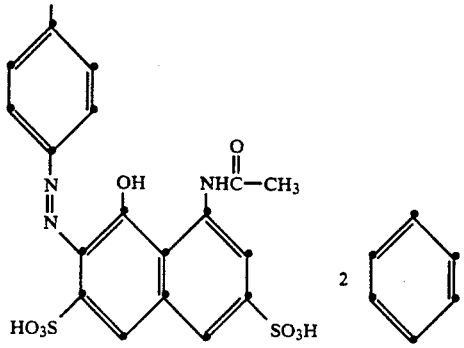
Coupler D
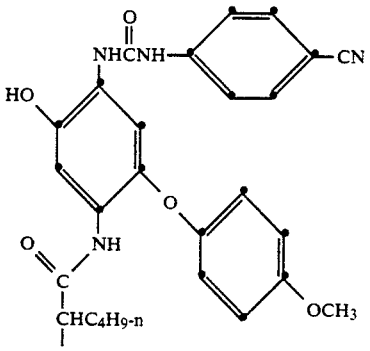
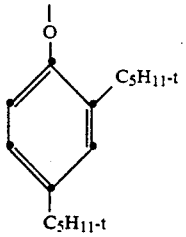
Coupler E
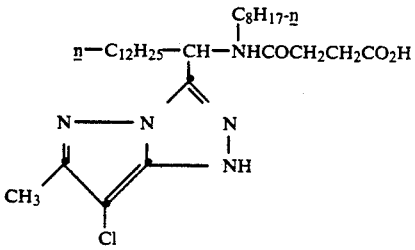
Coupler F -continued
Structures
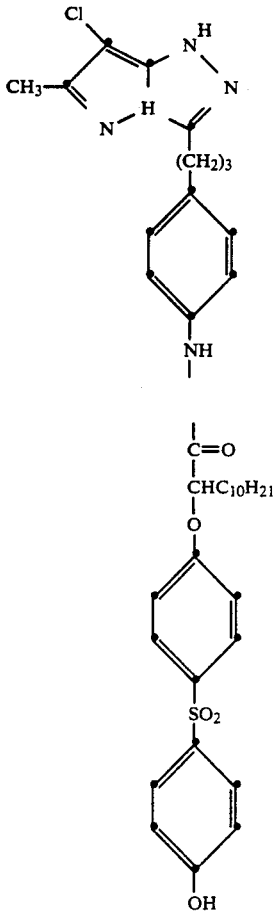
Coupler G
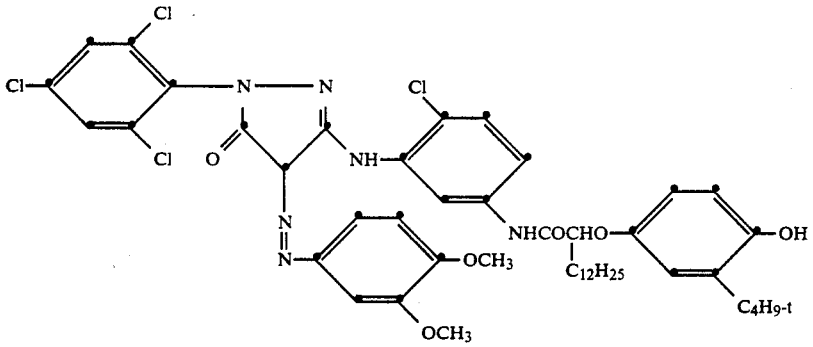
Coupler H
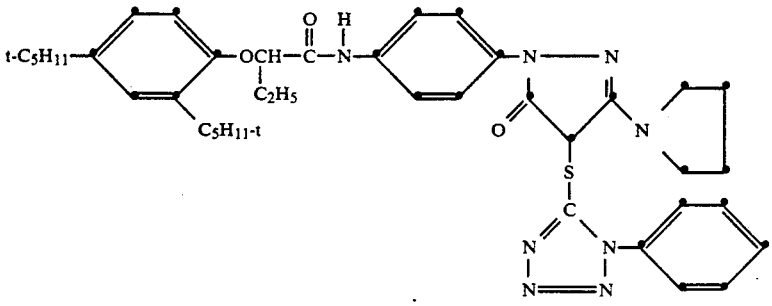
Coupler I -continued
Structures
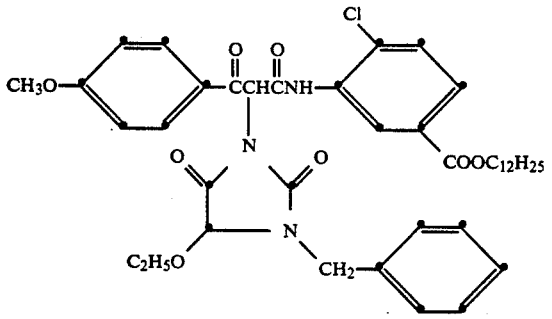
Coupler J
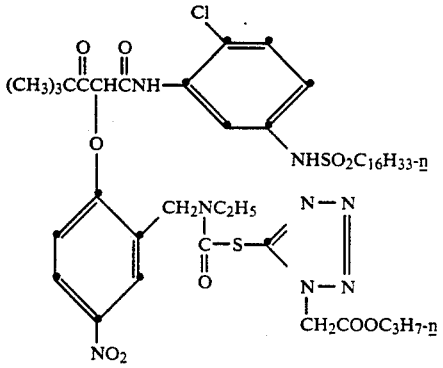
Coupler K
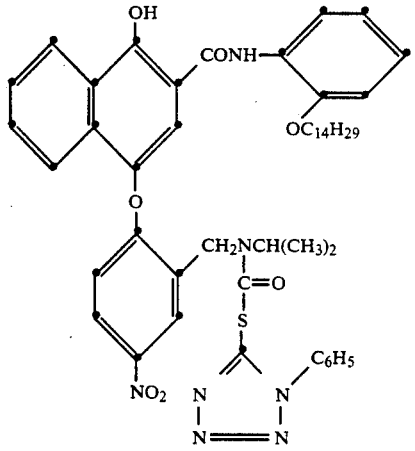
Coupler L
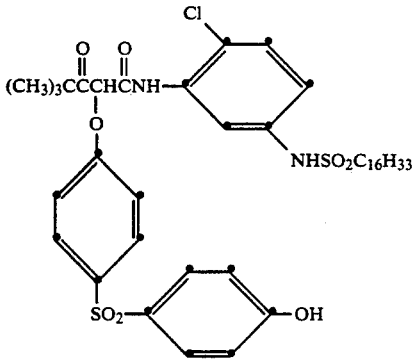
Coupler M -continued
Structures
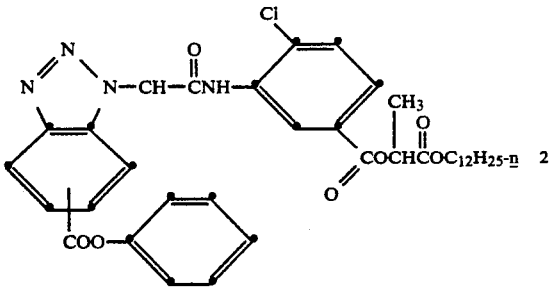
Coupler N
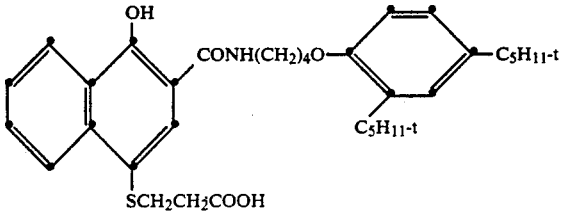
YD-1
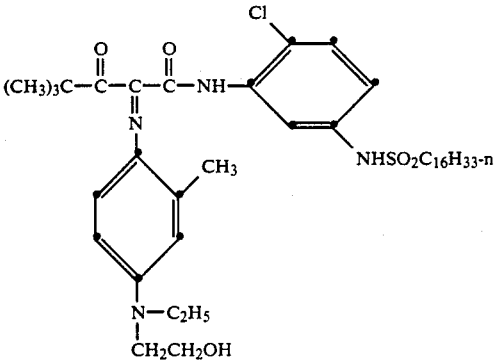
MD-1
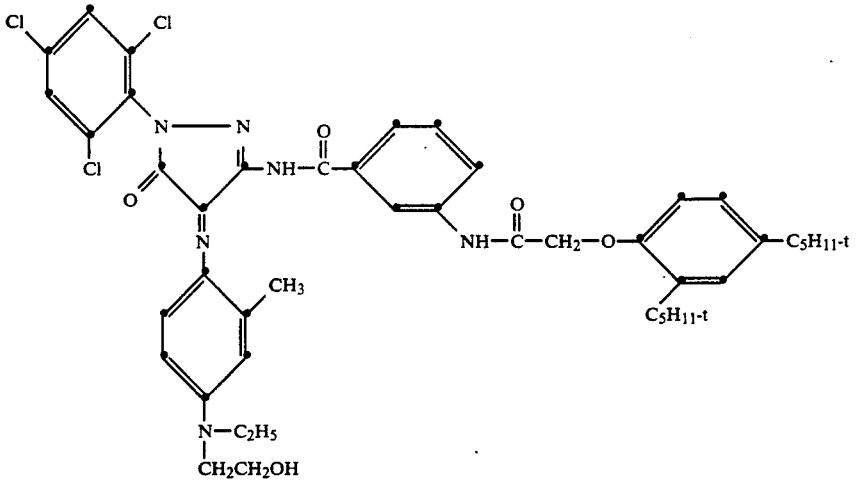
UV-1
$(C_6H_{13})_2—N—CH=CH—CH=C(CN)_2$
UV-2
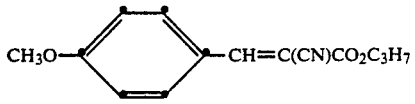

-continued

Structures

H-1

$CH_2{+}SO_2{-}CH{=}CH_2)_2$

As further illustration of the ability of high tabularity emulsions, coated in thin layers and at low silver to coupler ratios, to produce a maximum image dye density of at least 2.0, a series of twenty bicolor incorporated coupler photographic coatings were prepared. The series was composed of five different silver bromoiodode (4.0 mole % I) emulsions of varying physical properties (three within and two outside the invention) having approximately the same surface area per grain to obtain equal spectrally sensitized speed. Each of the five emulsions was coated in four separate element types which differed in the amount of material in the magenta unit. Three provided elements having unit silver, silver/coupler ratio, and thickness values of the invention and the fourth serves as a control. The materials were prepared by coating the following layers in order, on a cellulose triacetate film support having an antihalation layer on the opposite side.

Element A (Invention)

Layer 1 Cyan Layer—comprising a blend of three red-sensitized silver bromoiodide grains, a medium size tabular grain emulsion (6.0 mole % $I^-$) at 0.91 $gAg/m^2$, a smaller tabular grain emulsion (3.0 mole % $I^-$) at 0.28 $gAg/m^2$ and a non-tabular grain emulsion (4.8 mole % $I^-$) at 0.97 $gAg/m^2$, gelatin at 2.59 $g/m^2$, cyan image forming coupler A at 0.72 $g/m^2$, DIR coupler K at 0.044 $g/m^2$, masking coupler C at 0.054 $g/m^2$, bleach accelerator releasing coupler N at 0.075 $g/m^2$, and antifoggant 4-hydroxy-6-methyl-1,3,3a,7-tetraazaindene at 0.071 $g/m^2$.

Layer 2 Interlayer—comprising gelatin at 1.29 $g/m^2$.

Layer 3 Magenta Layer—comprising one of the five green-sensitizing silver bromoiodide emulsions (4.0 mole % $I^-$) described in Table I at 0.49 $gAg/m^2$, gelatin at 1.30 $g/m^2$, and image forming coupler E at 0.49 $g/m^2$.

Layer 4 Protective Overcoat—comprising gelatin at 1.08 $g/m^2$ with 2.0% by weight to total gelatin of hardener H-1.

Element B (Invention)

A second photographic recording material, designated Element B, was prepared in a similar manner to Element A with the following modifications to the Magenta dye forming unit.

Layer 3 Magenta Layer—green-sensitized silver bromoidodie emulsion was increased to 0.72 $gAg/m^2$. Gelatin was increased to 1.86 $g/m^2$, and image forming coupler E was increased to 0.72 $gAg/m^2$.

Element C (Invention)

A third photographic recording material, designated Element C, was prepared in a similar manner to Element A with the following modifications to the Magenta dye forming unit.

Layer 3 Magenta Layer—green-sensitized silver bromoidide emulsion was increased to 1.00 $gAg/m^2$. Gelatin was increased to 1.95 $g/m^2$.

Element D (Control)

A fourth photographic recording material, designated Element D, was prepared in a similar manner to Element A with the following modifications to the Magneta dye forming unit.

Layer 3 Magenta Layer—green-sensitized silver bromoidide emulsions was increased to 1.73 $gAg/m^2$. Gelatin was increased to 2.91 $g/m^2$.

The photographic elements were exposed for 1/10 of a second to a 600 W, 3000° K. tungsten light source that was filtered by a Daylight Va filter to 5500° K. and a green Wratten 99 filter through a graduated 0–4.0 density step tablet, and they were processed for 3.25 minutes under the conditions described above. The film strips were then evaluated for net maximum density (Dmax-Dmin).

The data in Table VI show that in order to get useful maximum density with low tabularity emulsions, it is necessary to use higher levels of silver and silver to coupler ratio which leads to thicker coatings.

TABLE IV

PROPERTIES OF EMULSIONS

| Emulsion | Mean ecd (μm) | Mean t (μm) | AR | $\bar{T}$ | Surface Area/Grain ($\mu m^2$) |
|---|---|---|---|---|---|
| I (Inv) | 1.97 | 0.079 | 25 | 316 | 6.66 |
| II (Inv) | 1.70 | 0.090 | 19 | 210 | 5.02 |
| III (Inv) | 1.98 | 0.042 | 47 | 1122 | 6.42 |
| IV (Control) | 1.27 | 1.27 | 1 | 1 | 5.07 |
| V (Control) | 1.58 | 1.58 | 1 | 1 | 7.84 |

TABLE V

Physical Description and Ingredient Coverages of The Four Formats of Magenta Unit in the Two-Unit Photographic Element

| | Unit Silver ($g/m^2$) | Unit Silver/Coupler Ratio | Unit Thickness (μm) |
|---|---|---|---|
| Element A (Inv) | 0.49 | 1.0 | 2.6 |
| Element B (Inv) | 0.72 | 1.0 | 3.5 |
| Element C (Inv) | 1.00 | 2.0 | 3.4 |
| Element D (Control) | 1.73 | 3.5 | 4.3 |

TABLE VI

Magenta Unit Photographic Performance

| | Net Maximum Density | | | |
|---|---|---|---|---|
| | Element A (Inv) | Element B (Inv) | Element C (Inv) | Element D (Control) |
| Emulsion I (Inv) | 2.9 | 3.9 | 3.0 | 2.9 |
| Emulsion II (Inv.) | 2.6 | 3.6 | 3.0 | 2.9 |
| Emulsion (III) (Inv) | 2.5 | 3.8 | 2.8 | 2.3 |
| Emulsion IV (Control) | 1.2 | 1.6 | 1.8 | 2.2 |
| Emulsion V (Control) | 1.0 | 1.2 | 1.5 | 1.9 |

The invention has been described in detail with reference to preferred embodiments thereof but it will be understood that variations and modifications can be effected within the spirit and scope of the invention.

We claim:

1. A color negative photographic recording material containing a support and at least two silver halide emulsion imaging units sensitive to different regions of the electromagnetic spectrum, each unit containing a dye forming coupler, at least one unit is a high tabularity unit which:

a) comprises from 0.2 to 2.0 g/m$^2$, based on silver, of a silver halide emulsion wherein greater than 50% of the projected area of the grains is provided by tabular grains having a tabularity of between 50 and 25,000;

b) has a thickness of less than about 4.0 μm;

c) comprises no more than 2.0 parts by weight of silver per part by weight of coupler;

d) has an exposure latitude of 2.0 or greater; and e) yields a maximum image dye density of at least 2.0, and a positive contrast of 0.9 or less when the recording material is exposed and processed; and at least one of the silver halide emulsion imaging units contains, in addition to the dye forming coupler, a masking coupler.

2. The recording material of claim 1 wherein the tabular grains have a tabularity of between 100 and 5,000.

3. The recording material of claim 1 wherein the tabular grains have a tabularity of between 100 and 2,500.

4. The recording material of claim 1 wherein said high tabularity unit comprises at least two silver halide emulsion layers having different sensitivities to the same region of the spectrum.

5. The recording material of claim 4 wherein the more sensitive layer comprises from 0.10 to 1.0 g/m$^2$ of silver.

6. The recording material of claim 4 wherein the more sensitive layer comprises from 0.20 to 0.6 g/m$^2$ of silver.

7. The recording material of claim 1 wherein there is from 0.8 to 1.5 part of silver per part of coupler in the high tabularity unit.

8. The recording material of claim 1 wherein there is from 0.5 to 1 part of silver per part of coupler in the high tabularity unit.

9. The recording material of claim 1 wherein the unit thickness of the high tabularity unit is from 2.5 to 3.5 μm.

10. The recording material of claim 1 which comprises at least 3 silver halide imaging units sensitive to different regions of the spectrum.

11. The recording material of claim 1 wherein the tabular grains comprise at least one of silver bromide or silver bromoiodide.

12. The recording material of claim 1, wherein the high tabularity unit is a cyan dye forming unit or a magenta dye forming unit.

* * * * *